US005806212A

United States Patent [19]

Benoit et al.

[11] Patent Number: 5,806,212

[45] Date of Patent: Sep. 15, 1998

[54] BOOT WITH ADJUSTABLE UPPER

[75] Inventors: Louis Benoit, La Balme de Sillingy; Pascal Pallatin, Seynod; Thomas Saillet, Annecy, all of France

[73] Assignee: Salomon S.A., Metz-Tessy, France

[21] Appl. No.: 728,980

[22] Filed: Oct. 11, 1996

[30] Foreign Application Priority Data

Oct. 20, 1995 [FR] France ..... 95 12554

[51] Int. Cl.[6] ..... A43B 5/04

[52] U.S. Cl. ..... 36/118.9; 36/118.2; 36/50.5; 36/119.1

[58] Field of Search ..... 36/118.2, 118.3, 36/118.4, 50.5, 118.9, 119.1

[56] References Cited

U.S. PATENT DOCUMENTS

| | | | |
|---|---|---|---|
| 3,496,054 | 2/1970 | Lange | 36/50.5 X |
| 3,945,135 | 3/1976 | Hanson et al. | 36/2.5 AL |
| 4,085,528 | 4/1978 | Delery | 36/119.1 |
| 4,809,448 | 3/1989 | Tonel et al. | 36/120 |
| 4,864,743 | 9/1989 | Begey et al. | 36/118.9 X |
| 4,888,889 | 12/1989 | Sartor | 36/117 |
| 5,031,341 | 7/1991 | Paris et al. | 36/118.9 X |
| 5,105,566 | 4/1992 | Legon | 36/121 |
| 5,109,615 | 5/1992 | Sartor | 36/121 |
| 5,175,948 | 1/1993 | Tonel et al. | 36/117 |
| 5,353,528 | 10/1994 | Demarchi | 36/118.9 |
| 5,381,613 | 1/1995 | Pozzobon et al. | 36/118.9 |

FOREIGN PATENT DOCUMENTS

| | | | |
|---|---|---|---|
| 0229638 | 7/1987 | European Pat. Off. . | |
| 0253306 | 1/1988 | European Pat. Off. . | |
| 0259721 | 3/1988 | European Pat. Off. . | |
| 430821 | 6/1991 | European Pat. Off. . | |
| 0467142 | 1/1992 | European Pat. Off. . | |
| 2476455 | 8/1981 | France | 36/50.5 |
| 2613914 | 10/1988 | France . | |
| 2652240 | 3/1991 | France . | |
| 2653310 | 4/1991 | France | 36/118.9 |
| 2128769 | 12/1971 | Germany | 36/118.9 |

*Primary Examiner*—Ted Kavanaugh
*Attorney, Agent, or Firm*—Greenblum & Bernstein P.L.C.

[57] ABSTRACT

A sport boot having a shell base with its sole and an upper that is provided with at least one tightening device mounted on a strap to surround the lower part of the skier's leg, on the one hand, and in its rear portion with at least one adjustment arrangement enabling it to adapt to the morphology of the rear zone of the lower part of the leg. The boot upper has a rigid lower element topped and connected by a linking element to a flexible upper element that is provided with at least one strap with its tightening device, and with at least one deformable portion. The deformable portion is located above the element in correspondence with the back zone of the lower element, such that by tightening the strap on the lower part of the leg, such portion presses against the rear zone of the latter by adapting to its morphology.

24 Claims, 6 Drawing Sheets

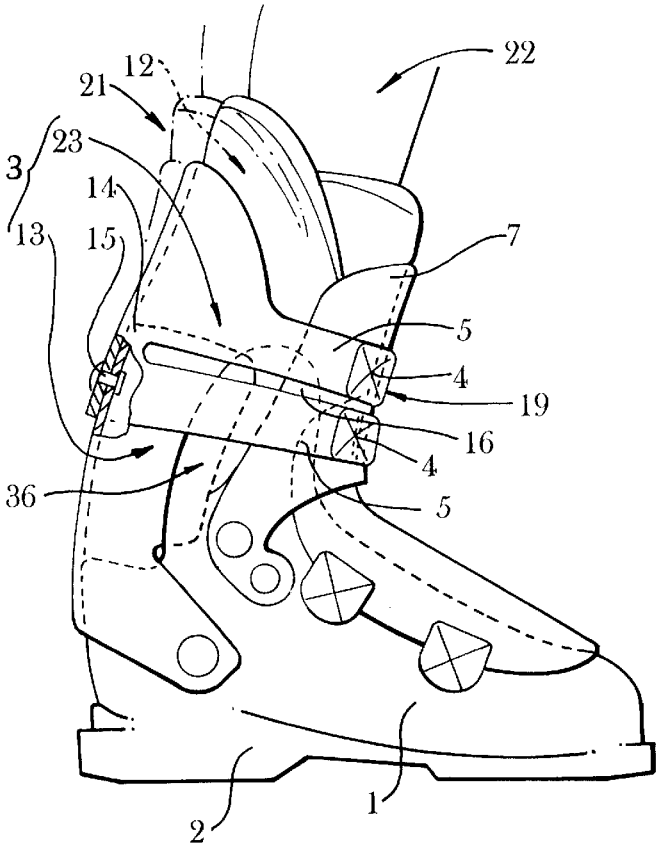
Fig. 2
Fig. 3
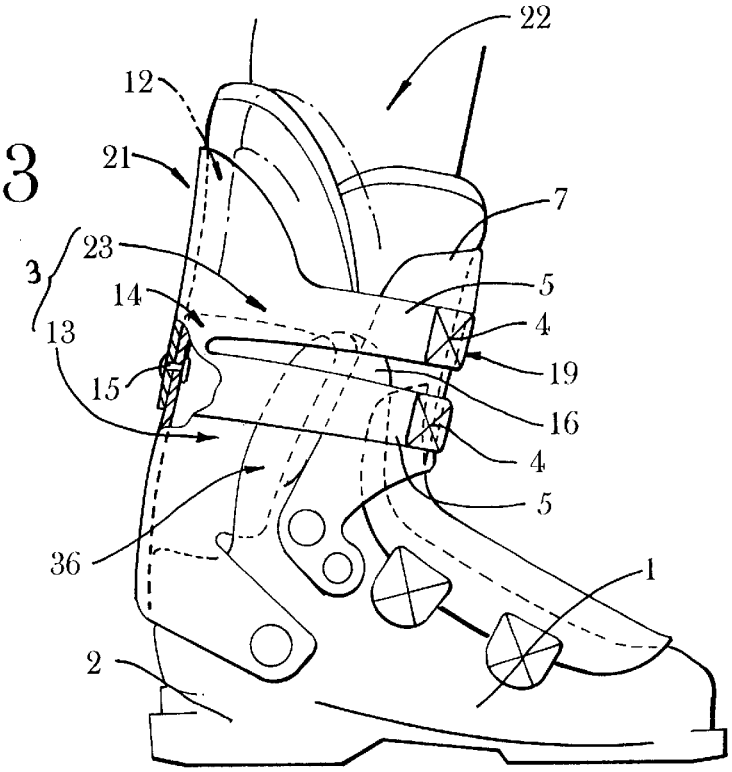

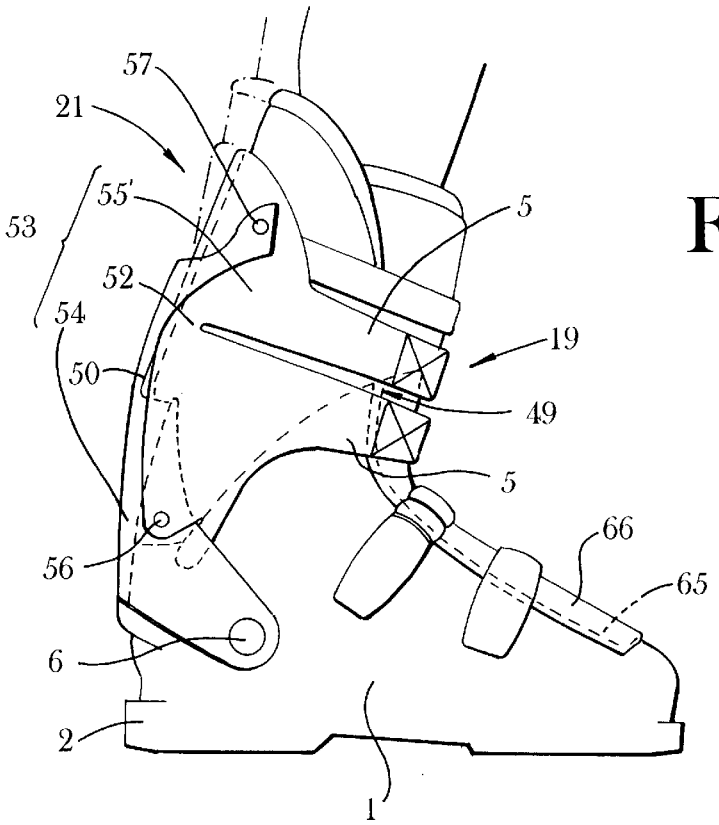
Fig. 10
Fig. 11
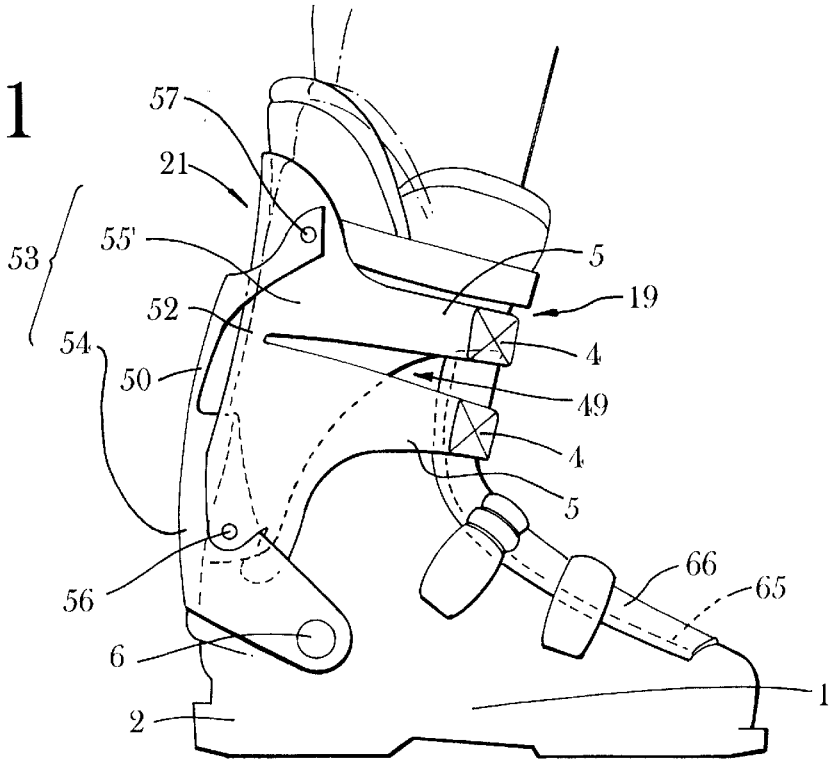

BOOT WITH ADJUSTABLE UPPER

BACKGROUND OF THE INVENTION

1. Field of the Invention

The present invention relates to an improvement to rigid shell sport boots in which the upper that tops the shell base, and which is adapted to surround the lower part of the leg of the skier by means of tightening devices, is provided in its rear portion with at least one adjustment means enabling it to be adapted to the morphology of the rear zone of the lower part of the leg.

2. Background and Material Information

Known sport boots of this type, such as the ski boots described, for example, in the Patents EP 229 638, FR 2 613 914, and U.S. Pat. No. 3,945,135, have a shell base topped by an upper adapted to surround the lower part of the leg of the skier by means of at least one tightening device. This upper is provided in its rear portion with at least one adjustment means enabling it to be adapted to the morphology of the rear zone of the lower part of the leg and has a stirrup-shaped rigid lower element whose arms are each connected by means of a journal to the shell base in the zone corresponding to that of the skier's malleoli, and whose back zone assumes approximately the shape of a half-tube extending vertically upwardly, substantially up to the zone of the base of the calf.

In these boots, the adjustment means are affixed to a rigid rear portion of the upper, which rigid portion is to be subjected to tightening devices, and extend in correspondence with the rear zone of the lower part of the skier's leg. They are preadjustable by means of devices that are specific thereto, i.e., which are independent of the tightening devices, the latter only being attached to the rigid rear portion of the upper to ensure the closure thereof. Thus, whether this relates to "rear entry" boots, as taught in the documents FR 2 613 914, U.S. Pat. No. 3,945,135 and EP 229 638, or to "front entry" boots, wherein the fitting of the boots is generally carried out by means of wedges or inserts positioned between the upper and the lower part of the leg and the coming of the rigid rear portion of the upper closer to the front portion and vice-versa, does not modify the position for pre-adjustment of the fitting means.

It results from this independence that it is impossible, during the closure of the upper, to automatically take into account the subsequent variations or modifications that are capable of affecting the configuration of the lower part of the leg when they occur unexpectedly during skiing.

This is especially what happens when the pre-adjustment of the fit of the boot is carried out directly on the lower part of the leg, whereas the skier, when skiing, uses more or less thick clothes which cover the lower part of the leg.

This happens also when the skier must protect himself by applying a bandage, a dressing, . . . etc., on the lower part of the leg. Thus, in the aforementioned known boots, a new adjustment of the fit is necessary each time a change causes a noticeable modification to the configuration of the lower part of the leg between the moment of pre-adjustment and of use, independently of the implementation of the tightening and closing devices of the boot. The tightening force of the latter can also be subject to unexpected modifications. This is the case when the skier needs, for example, to increase the retention of the lower part of his or her leg right before to the start of a ski race, or right before engaging in a delicate passage during "off-run skiing", or conversely to have more freedom for a relaxed-type skiing and/or for physiological problems related to blood circulation (cooling), for example, or stemming from a nervous muscular cramps which can occur unexpectedly.

To better account for these variables of the fit and of the closure of the upper in these boots, it is always necessary to intervene on the fitting means and on the tightening devices. Furthermore, for boots where the adjustment means extend over a large zone such as that extending from the heel to the base of the calf, such that according to the documents FR 2 613 914 and U.S. Pat. No. 3,945,135, it can be advisable to adjust the fit and the tightening, when skiing, between the lower part of the upper at the heel zone and the upper portion at the base of the calf. Indeed, between these extreme portions of the upper, the lower part of the leg has contact zones which are more or less sensitive, such as the Achilles tendon, bone protuberances, etc., and more or less variable in volume depending on the temperature, such as the muscular mass of the calf.

However, these boots have tightening devices which essentially cooperate with the rigid rear portion of the upper. It is therefore not possible to selectively adjust the tightening force along the fitting means by simply acting on the tightening devices.

SUMMARY OF THE INVENTION

An object of the present invention is to remedy the various drawbacks of the previous boots and to propose an improvement which makes it possible to ensure, simultaneously with the embodiment of the tightening devices, and as a function of the tightening force which they exert, the adaptation of a fitting means to the morphology of the lower part of the leg and the closure of the upper thereon by making it possible to proportion said tightening force along the fitting means.

According to the invention, the sport boot with a rigid shell has a shell base topped by an upper adapted to surround the lower part of the leg of the skier by means of at least one tightening device, the upper being provided in its rear portion with at least one fitting means enabling it to adapt to the morphology of the rear zone of the lower part of the leg, and having a rigid stirrup-shaped lower element whose arms are each connected via a journal at the shell base in the zone corresponding to that of the malleoli, and whose back zone assumes approximately the shape of a half-tube which extends vertically and upwardly, substantially up to the base of the calf. The rigid lower element of the upper is equipped with a collar-shaped flexible upper element which has, in its back zone, at least one elastically deformable portion which is located in correspondence with the back zone of the lower element, and above, at least one linking element ensuring the assembly of the lower and upper elements to one another, and in that the flexible upper element has at least one strap equipped with a tightening device and originating from its deformable portion. This upper element thus makes it possible to close the upper of the boot by surrounding the lower part of the leg of the skier, taking into account its perimeter, on the one hand, and due to its flexibility and to its deformable portion located above the element for linking with the upper element, to press against the rear zone of the lower part of the leg, and thus to adapt to the morphology thereof, thus constituting the fitting means, on the other hand.

According to an embodiment, the rigid lower element is equipped with a flexible strap, with a tightening device, which originates from its rigid back zone. This arrangement makes it possible to improve the retention of the lower part of the leg at the level of the lower element by acting on the front zone of the lower part of the leg, especially in the vicinity of the flexion fold and of the instep, without acting on the fitting and closing means of the upper constituted by the flexible upper element.

According to another embodiment, the arms of the stirrup of the rigid lower element are reduced in the direction of the back zone of such element up to a height substantially greater than the height of the heel zone, and they form a horizontal shoulder before being extended, in the back zone, by a single vertical extension ending with a free end, which is also rigid, up to the zone of the base of the calf.

Complementarily, the flexible upper element is obtained, in its back zone, with a vertical scallop opened downwardly, the elastically deformable portion then being located in the portion without scallop. This scallop determines two cheeks and enables the assembly of the lower and upper elements to one another by nesting, the cheeks of the upper element covering at least partially the arms of the stirrup of the lower element, while the vertical extension thereof covers the portion without scallop of the back zone of the upper element.

In this embodiment, a linkage with the rigid lower element is provided, as previously, beneath the elastically deformable portion, for example between the cheeks and the arms of the stirrup, but also above the deformable portion, between the free end and the back zone without scallop of the upper element.

Thus, when at least one strap equipped with a tightening device and originating from this deformable portion of the back zone of the upper element and tightened on the lower part of the leg of the athlete, and on the front portion of the upper, the upper element bends between its linkage points in the area of its deformable portion which, consequently, comes closer and presses more or less on the rear zone of the lower part of the leg, depending on the morphology thereof and on the tightening force exerted by the tightening device, which thus constitutes the fit.

Still according to the preceding embodiment, the flexible upper element can be provided with two flexible straps, equipped with tightening devices, originating from the back zone and separated from each other by a notch which extends up to the back zone. The notch thus obtained allows a junction portion, which is easily deformable in flexion, to remain between the straps.

It results from such a structure that by varying the tightening force between the two straps, the deformable portion of the flexible upper element tends to deform further in the area where the force is the most substantial. It is therefore possible, in this case, to modify the tightening force and the fit along this deformable portion that is a part of the flexible upper element which constitutes the fitting means.

BRIEF DESCRIPTION OF DRAWINGS

Other characteristics of the invention will become apparent from the following detailed description, with reference to the attached schematic drawings illustrating, by way of examples other possible embodiments, and in which:

FIGS. 2 and 3 are elevational views showing the ski boot of FIG. 1 with the embodied fitting means, in FIG. 2 on a small lower part of the leg of a skier, and in FIG. 3 on a large lower part of the leg of a skier, respectively;

FIGS. 10 and 11 are elevational views illustrating the boot of FIG. 9 whose upper is closed and adapted on a small lower part of the leg in FIG. 10, and on a large lower part of the leg in FIG. 11

DETAILED DESCRIPTION OF THE PREFERRED EMBODIMENTS

Figure 1:
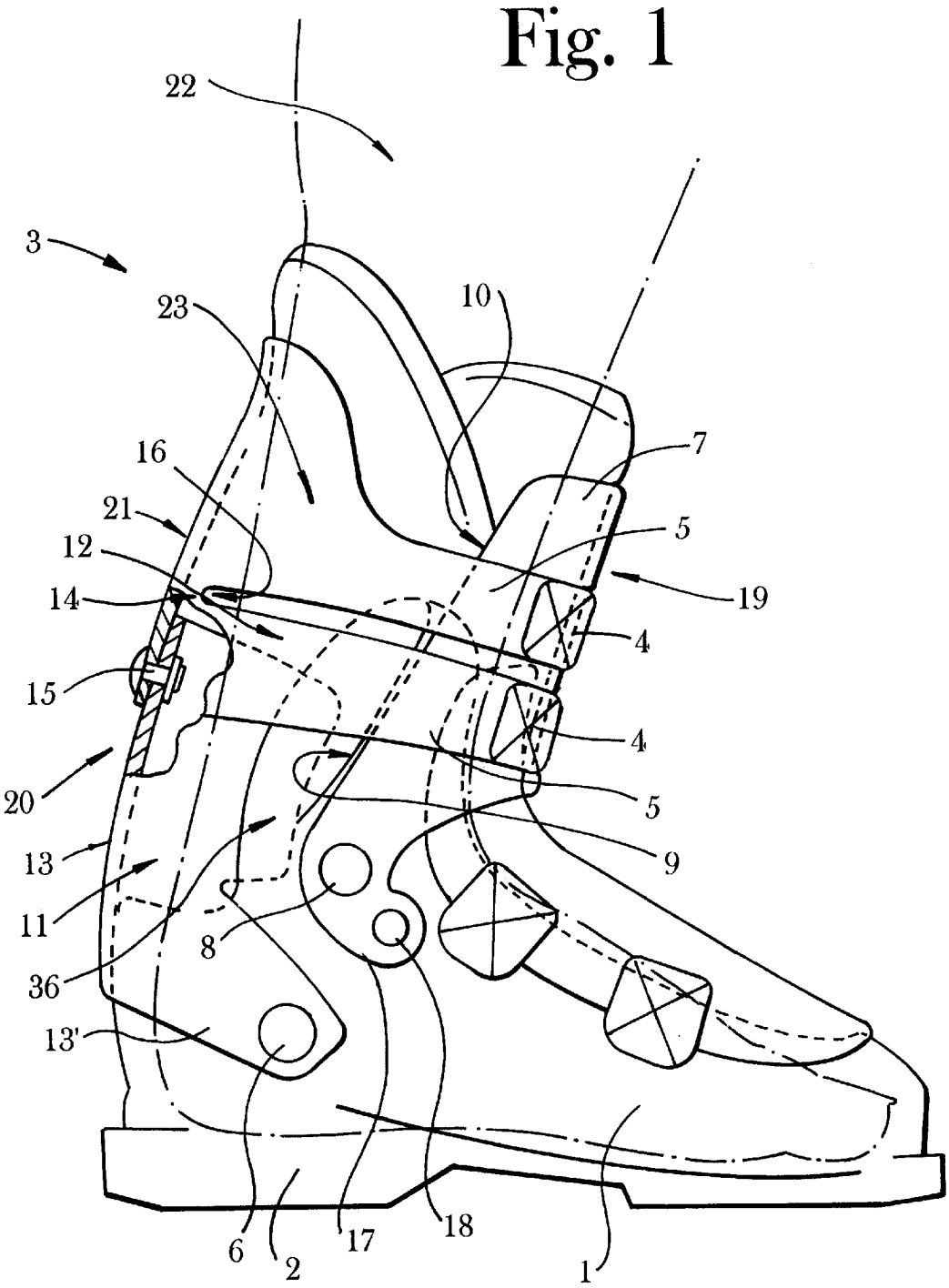
FIG. 1 is an elevational view showing a sport boot such as a ski boot in a closed position having an upper, with a means for adjusting to the morphology of the rear portion of the lower part of the leg, according to a first embodiment.

The ski boot shown in FIG. 1 has a shell base 1, provided with a sole 2, and an upper 3 adapted to surround the lower part of the leg of the bearer, i.e., the skier, by means of tightening devices 4 of a known type, with which flexible straps 5 from the rear portion 20 of the upper 3 are provided. This upper 3 is connected to the shell base 1, in the zone corresponding to the malleoli, by means of a rigid lower stirrup-shaped element 13, whose arms 13' are each fixed via a journal 6 to the shell base 1; the back zone 11 of the stirrup of the lower element 13 approximately has the shape of a half-tube which extends upwardly, substantially up to the base of the calf, i.e., at least by covering the Achilles's tendon, as is indicated by the reference 12.

According to one characteristic, the rigid lower element 13 is equipped with a flexible collar-shaped upper element 23 to which it is assembled in a linking zone by means of a linking element 15, the lower element 13 and the upper element 23 thus forming the upper 3 of the boot. The collar-shaped upper element 23 includes straps 5 for tightening and closing the upper 3, i.e., two straps, and has in its back zone 21 an elastically deformable portion 14 located in correspondence with the back zone 11 of the lower element 13 which it partially covers, and above the linking element 15. This elastically deformable portion 14 is formed by a material bridge or junction portion located between the two straps 5 which are separated from each other by a notch 16 extending up to the back zone 21 of the upper element 23. In a general sense, the deformable portion 14 can be considered to be constituted by a reduced dimension portion of the upper element 23, such as being constituted by a reduced width portion defined by the notch 16.

With these arrangements, the closure elements of the upper element 23 are constituted by the straps 5 and the tightening devices 4 in correspondence with the front portion of the lower part of the leg, i.e., the tibial zone 19, which has the least morphological variations, on the one hand, and its deformable portion 14 in correspondence with the rear zone 12 which has the most substantial morphological variations, especially due to the muscular mass of the calf, its high location, and its more or less pronounced transverse curve on the external and internal flanks of the lower part of the leg, on the other hand.

Thus, when closing the upper 3 by means of the tightening devices 4 and straps 5, the flexible upper element 23 can be adjusted to the perimeter of the lower part of the leg through a support on the tibial zone 19, and can adapt to the morphology of the base of the calf through an elastic deformation of its portion 14 that is weakened by the notch 16, and located above the linking element 15. In fact, in the example of construction shown, the flexible upper element 23 does not take support directly on the tibial zone 19 of the lower part of the leg, but on a front cuff 7 shaped like a half-tube which partially covers the lateral extensions 36 on which it is pivotally mounted about axes 8, these extensions forming the flanks of the shell base 1. Shoulders 9 are provided on the lateral extensions 36 and arranged opposite the rear edges 10 of the cuff 7 to serve as a support and an abutment for the latter when it is subject to a force which tends to make it pivot rearwardly, which is the case when the skier presses against the rear of the upper 3 through the flexible upper element 23, when the straps 5 are closed on the cuff 7.

In such a boot, the control of the forward flexion can advantageously be made by means of flexible ears or ear-like portions 17 affixed to the cuff 7 which extend on this side of its pivoting axes 8, and which are anchored at a distance from the latter, at points 18. Thus, in the interval comprised between the axes 8 and the points 18, the ears 17 can deform elastically when the front cuff 7 bias them to pivot together with it and oppose a certain resistance.

FIGS. 2 and 3 illustrate the ski boot of FIG. 1 adapted to a lower part of the leg 22 having a small calf in FIG. 2, and a large calf in FIG. 3. In both cases shown by way of example, the flexible straps 5 with their tightening devices 4 can be adjusted to the perimeter of the considered lower part of the leg 22, by taking support on the tibial zone 19 thereof via the inserted front cuff 7, and the straps each pull on the deformable portion 14, but in a differentiated manner. Indeed, due to the fact that the morphological variations are less in the zone of the tendons, especially at the Achilles tendon, than in the area of the fleshy portions of the muscles of the calf, the highest strap 5 is more tightened or untightened than the lowest strap 5. This difference in pulling between the two straps 5 therefore causes the elastic deformation of the portion 14 of the flexible upper element 23 in its back zone 21, and consequently the coming together or the spacing apart of the edges of the notch 16 separating the straps 5. Thus, as shown in FIG. 2 which relates to an adjustment on a lower part of a leg 22 with a small calf, the highest strap 5 is tightened until the back zone 21 of the flexible upper element 23 presses on the zone 12 of the base of the calf. In so doing, the highest strap 5 causes the forward flexion of the deformable portion 14 connecting it to the lowest strap 5, and the edges of the notch 16 come closer together on the side of the front zone 19 of the lower part of the leg. Conversely, for an adjustment for a large calf, as shown in FIG. 3, the back zone 21 of the flexible element 23 presses on the zone 12 of the base of the calf which forces it to bend rearwardly due to its curve, as soon as the upper 3 is closed on the lower part of the leg by means of the lowest strap 5. By bending rearwardly, the back zone 21 of the flexible upper element 23 causes the flexion of the deformable portion 14 in the same direction, and the spacing of the highest strap 5 from the lowest strap 5. As a result, the edges of the notch 16 are spaced apart in the front zone 19 of the lower part of the leg.

Figure 4:
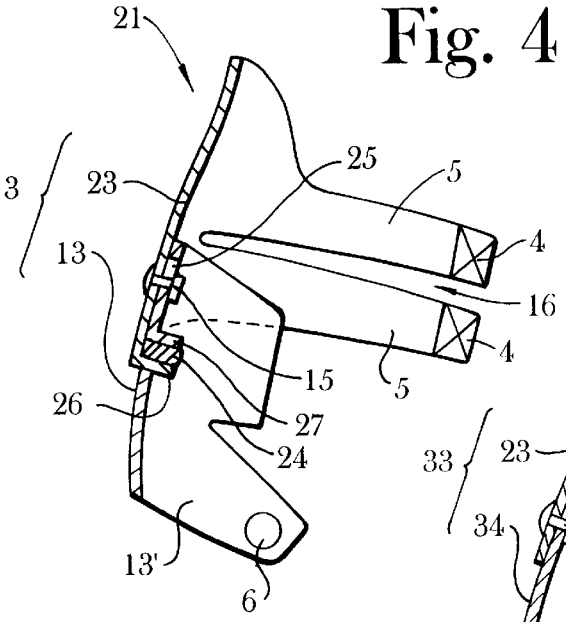
FIGS. 4, 5, and 6 are elevational cross-sectional views of the elements of an upper having a fitting means according to various alternative embodiments.

According to an alternative embodiment shown in FIG. 4, the upper 3 of the boot is constituted, as previously described, by a rigid lower element 13 and a flexible upper element 23 connected to each other by a linking element 15, such as a rivet, but is additionally provided with means permitting a translational displacement in the vertical direction of said lower element 13 and upper element 23 between them. These means consist of an oblong slot 25 obtained in the rigid lower element 13 in the area where the linking element 15 passes and whose width is of course at least greater than the width of the transverse section of the element 15 which must freely slide inside. The flexible upper element 23 can thus move in translation in the oblong slot 25, driving the linking element 15 with it, within the limits imposed by the length of the slot 25. Advantageously, an elastic means 24 can be associated with the lower elements 13 and 23 to maintain the latter in a constant initial position and interact between each other by opposing an elastic resistance during their translational displacement. In the case of the construction shown, the elastic means 24 is inserted between a lower support edge 26 projecting from the upper element 23 and an upper support edge projecting from the lower element 13.

It is to be understood that a viscoelastic element can also be interposed between the portions of the lower element 13 and of the upper element 23 which are superposed. Such an arrangement provides a braking/absorption of the translational displacement, without return to a constant initial position.

Figure 5:
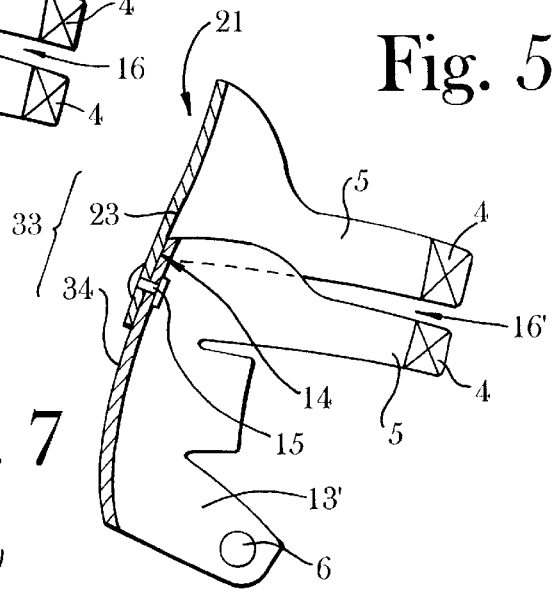
Figure 6:
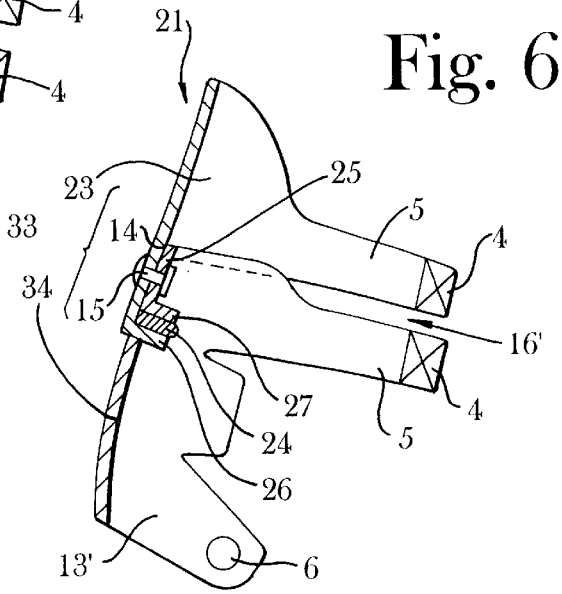

According to other variations, as shown in FIGS. 5 and 6, the upper 33 can be constituted by a flexible upper element 23' which has a single flexible strap 5 with its tightening device 4, and by a rigid lower element 34 also provided with one flexible strap 5 with its tightening device 4. An upper 33 so designed adjusts and adapts to the lower part of the leg of the skier in a manner similar to the upper 3 which has been described with reference to FIGS. 1, 2 and 3. Indeed, the morphological variations of the base of the calf are still taken into account by the back portion 21 of the flexible upper element 23 which includes the deformable portion 14, which remains located in correspondence with the back zone 11 of the lower element 34 in the vicinity of and above the linking element 15. In fact, the straps 5 are separated from each other by a slot equivalent to a notch 16' and are therefore adjustable independently of one another despite the fact that both participate in the tightening and the closing of the upper 33 on the lower part of the leg of the skier. In this construction of the upper 33, the flexible upper element 23' can be connected by a linking element 15 to the rigid lower element 34 with no possibility of translational displacement with respect to the latter, which is the case shown in FIG. 5. On the contrary, as in the example described in FIG. 4, the flexible upper element 23' can be provided with means 24, 25, 26, 27, allowing its translational displacement with respect to the rigid lower element 34.

Figure 7:
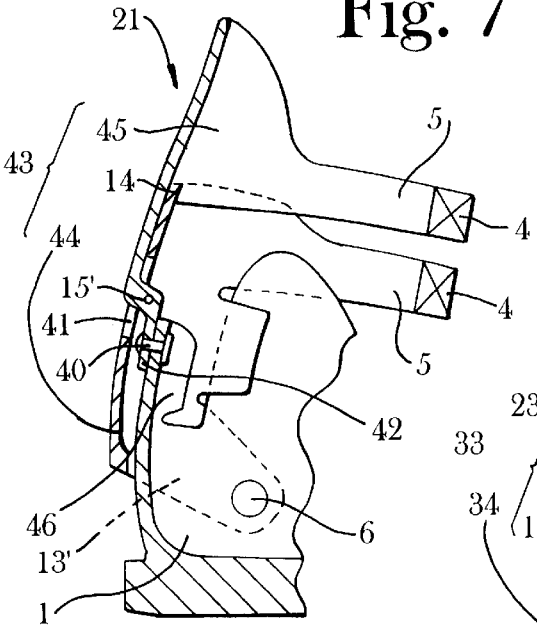
FIG. 7 is a partial and elevational cross-sectional view of the rear portion of a ski boot having an upper with a fitting means connected to a heel retention tongue extending from the shell base.

In the alternative construction shown in FIG. 7, the upper 43 has a rigid lower element 44 and a flexible upper element 45 each provided with a flexible strap 5 with its tightening device 4, and is connected by means of a known assembly means 40, in addition to its journals 6 at the shell base 1 of the boot, to a flexible heel retention vertical tongue coming from the shell base.

To allow for the rearward tilting of the upper 43, the lower element 44 and the upper element 45 are then slidably nested in one another, for example, by means of a finger 42 which extends beneath the deformable portion 14, from the upper element 45 up to the tongue 46, passing through an oblong slot 41 obtained in the lower element 44. The linking element 15' can be constituted by a transverse pin inserted in the finger 42 opposite the slot 41. With these arrangements, the relative translational movement of the flexible upper element 45 with respect to the rigid lower element 44 which occurs when the upper 43 tilts rearwardly and/or forwardly, due to the fact that one has an axis 6 on the shell base 1, and the other has an axis 40 on the flexible tongue 46, is not hindered. Furthermore, as in the example described in FIGS. 4 and 6, an elastic means can be associated with the lower element 44 and with the upper element 45 to maintain them in a constant initial position, and to oppose an elastic resistance thereto during their translational displacement with respect to each other.

Figure 8:
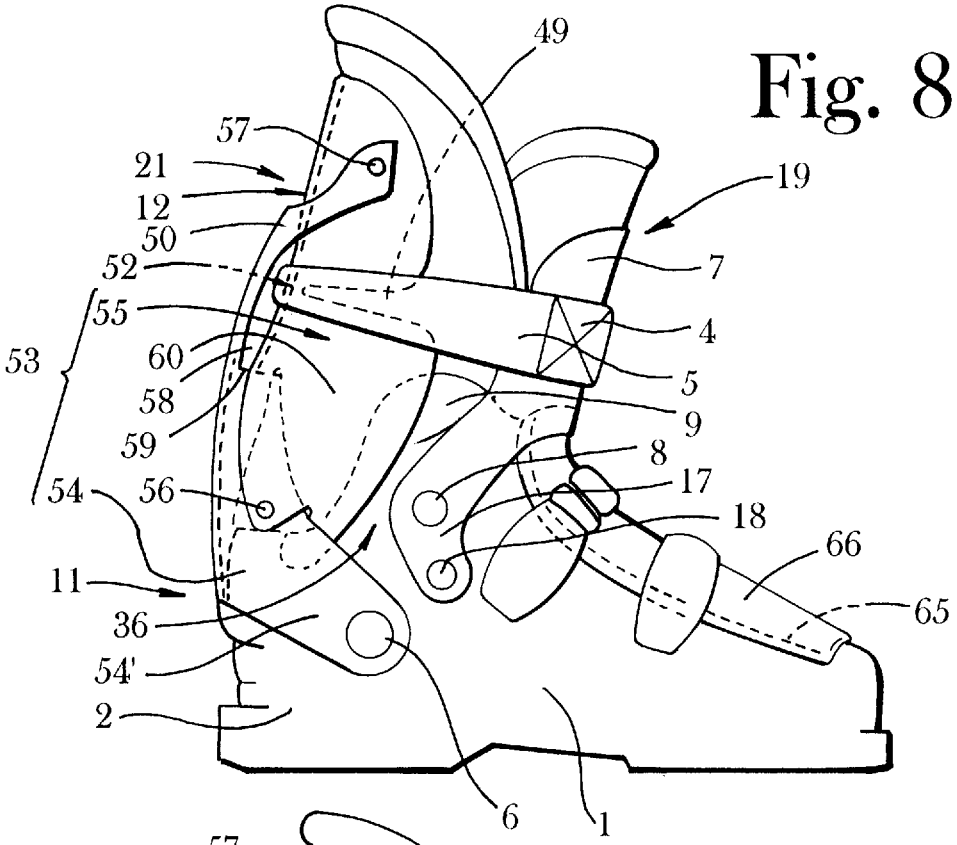
FIGS. 8 and 9 are elevational views of a ski boot in a closed position having an upper, with a means for adjusting to the morphology of the rear portion of the lower part of the skier's leg according to a second embodiment.

According to another embodiment of the invention, shown in FIG. 8, the upper 53 still has a rigid lower element 54 and a flexible upper element 55 which are connected to one another by a linking member 56 located beneath an elastically deformable portion 52 that is a part of the upper element 55 and extends in its back zone 21, but is provided additionally with another linking member 57 located above the deformable portion 52. A flexible strap 5 with its tightening device 4 projects from the back zone 21 of the flexible upper element 55, and is closed on the front zone 19 of the lower part of the leg by an inserted front cuff 7 mounted at pivot axes 8 in the same manner as in the boot described with reference to FIG. 1. Therefore, one finds again the shoulders 9 provided on the lateral extensions 36 of the shell base 1 which serve as a rearward abutment and support for the front cuff 7 and the flexible ears 17 anchored in 18 which participate in the control of the forward flexion of the cuff 7 by opposing an elastic resistance.

In this embodiment, the lower element 54 and the upper element 55 are provided to nest into one another. Therefore, the arms 54' of the stirrup of the lower element 54, which are journalled at elements 6 on the flanks of the shell base 1, are reduced in the direction of the back zone 11 of the element 54 up to a height substantially greater than the heel area, and constitute a horizontal shoulder 59, then are extended in the back zone 11 by a single, equally rigid, vertical extension 50 up to the zone 12 of the base of the calf. Complementarily, the flexible upper element 55, generally shaped like a half-tube, has in its back zone 21 a vertical recess or scallop 58 open downwardly which determines the cheeks 60 and whose end is adapted to rest on the shoulder 59 of the arms 54' of the lower element 54. Thus, when the flexible upper element 55 is nested on the rigid lower element 54, its cheeks 60 partially cover the arms 54' of the stirrup thereof, its back portion 21 where the deformable portion 52 is located slides under the rigid vertical extension 50, and the end of its scallop 58 presses on the shoulder 59 of the arms 54. Once nested, the lower 54 and upper 55 elements are assembled to one another by means of the linking element 56 located beneath the deformable portion 52, between the cheeks 60 and the arms 54' of the stirrup of the lower element 54, and by means of the linking means 57 positioned above the deformable portion 52, between the free end 61 of the rigid vertical extension 50 and the back zone 21 of the opposite upper element 55. Advantageously, as in the previous constructions, the flexible upper element 55 is made with a transverse notch 49 which extends next to its back zone 21 to define the preferred deformable portion 52. This notch 49 is located approximately at half-distance from the linking elements 56 and 57, and the flexible strap 5 with its tightening device 4 is therefore affixed to the flexible upper element 55 at the level of its deformable portion 52 such that it covers the notch 49. With this construction, one obtains an upper 53 which, when the strap 5 is closed on the lower part of the leg of the skier (not shown), adjusts to the morphology of the rear portion 12 of the lower part of the leg adjusting simultaneously, i.e., by a single operation common to both functions of adaptation and tightening/closure, to the perimeter of the lower part of the leg, as in the constructions previously described, but this time, through a deformation between two linking elements 56 and 57.

Figure 9:
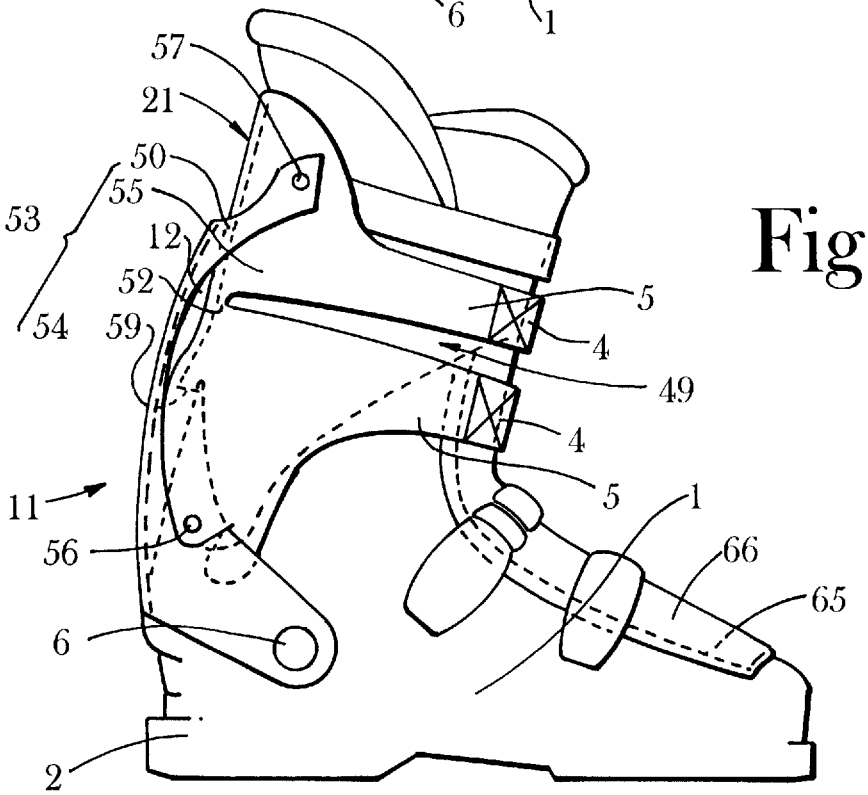

In the example of the boot shown in FIG. 9, the upper 53' is distinguished from the upper 53 of FIG. 8 merely by the fact that the flexible upper element 55' is equipped with two flexible straps 5, which are separated by the notch 49, instead of one strap 5. The functioning of such an upper 53' is substantially comparable to that of an upper 3 with two straps 5 as explained with reference to FIG. 1. Indeed, for an adaptation to a small calf, FIG. 10, the deformable portion 52 bends forwardly, and the edges of the notch 49 separating the straps 5 come closer together in the front zone 19 of the upper. Conversely, for an adjustment to a large calf, FIG. 11, the deformable portion 52 bends rearwardly and the edges of the notch 49 separating the straps 5 are spaced apart, due to the fact that the highest strap 5 adapts to the curve of the fleshy portion of the base of the calf.

On the contrary, the deformable portion 52 being located and caught between the linking elements 56 and 57, its forward flexion, shown in FIG. 10, is also accompanied by a backward motion in the direction of the vertical extension 50, and its rearward flexion, shown in FIG. 11, is accompanied by a distancing motion of the vertical extension 50. It also results from this assembly that, by varying the tightening force generated by one and/or the other of straps 5, one also modifies the adaptation of the back zone 21 of the flexible upper element 55' on the rear portion of the lower part of the leg.

Figure 12:
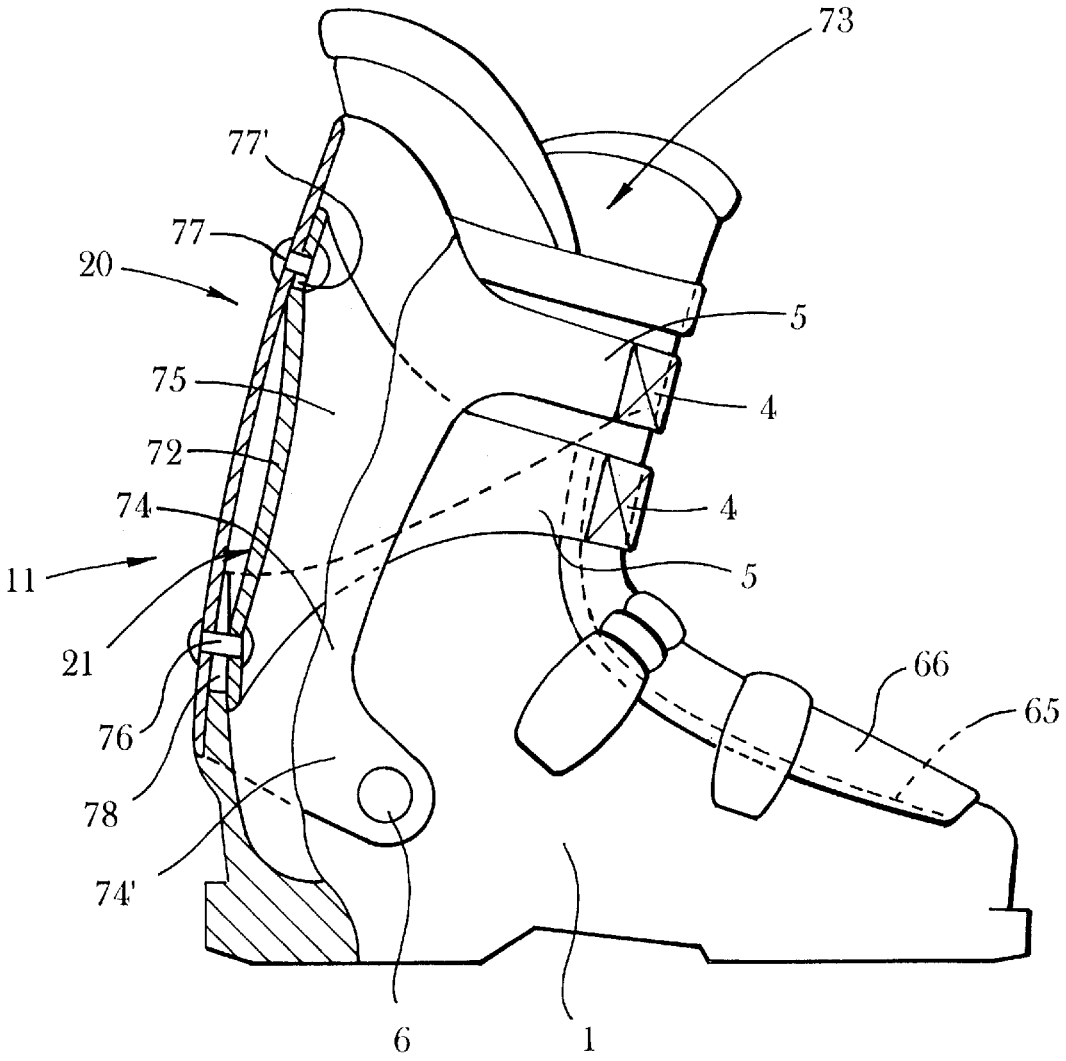
FIG. 12 shows another alternative embodiment of the means for adjusting to the morphology of the rear portion of the lower part of the leg.

According to another embodiment shown in FIG. 12, the upper 73 is equipped, in its rear portion 20, with an adjustment means enabling it to adapt to the morphology of the rear part of the leg of the wearer. To this end, the boot has a rigid element 74 whose stirrup-shaped lower portion with arms 74' is connected via a journal 6 to the shell base 1, on the one hand, and a flexible upper element 75 which has, in its back zone 21, at least one deformable portion 72. As described previously, especially with reference to FIG. 9, the flexible upper element 75 is connected by a linking element 76 located beneath its deformable portion 72, and by a linking element 77 positioned above and located on the rigid back zone 11 of the element 74. On the contrary, only one flexible strap 5 with its tightening device 4 projects from the back zone 21 and closes on the front zone 19 of the boot in correspondence with the lower part of the leg of the skier. So as not to hinder the flexion of the upper 73 with respect to the shell base 1, the linking element 76 is passed through a vertical slot 78 obtained in the wall of the shell base 1 which is "sandwiched" between the back zone 11 of the rigid element 74 and the back zone 21 of the flexible element 75. Such arrangement also makes it possible to provide a flexible element 75 whose deformable portion 72 extends very deep in the shell base 1, which is therefore capable of perfectly assuming the rear profile of the skier's leg.

According to another characteristic, the rigid lower element 74 is approximately shaped like a half-tube which extends upwardly to constitute the upper edge of the upper 73. To this end, it is equipped with a flexible strap 5 and a tightening device 4 Adapted to close the upper portion of the upper 73. It results from this structure that the back zone 11 of the rigid element 74 envelops the entire back zone 21 of the flexible element 75.

Preferably, to facilitate the shaping and/or the adaptation of the deformable portion 72 of the flexible element 75 on the rear portion of the lower part of the leg of the bearer, one of the linking elements 76, 77 allows for a sliding of such portion 72 with respect to the rigid back zone 11 of the element 74.

Thus, in the example of the construction shown, the linking element 77, which is a rivet, cooperates with an oblong slot 77' obtained in correspondence with the back zone 21 of the flexible element 75.

The functioning of the upper 73 of the boot is substantially comparable to that of the upper 3 or 53' with two straps 5, as explained with reference to FIGS. 1 and 9. Indeed, depending on whether it is an adaptation to a small or to a large calf, the deformable portion 72 of the flexible upper element 75 bends more or less in the direction of a camber directed to the front 19 of the boot and thereby directs the strap 5, which comes from the back zone 21, in a more or less convergent or divergent direction with respect to that 5 of the rigid element 74.

It is to be understood that the uppers 3, 33, 43, 53, 73, previously described, can be adapted or modified to be integrated into other boots, especially into boots whose structure can have a front portion which can be opened by transverse flaps or by a cuff, and/or into boots where the rear support of the upper 3, 33, 43, 53, 73, with respect to the shell base 1 is provided by an abutment in the heel zone instead of the abutment of the front cuff 7 on the shoulders 9 located on the flanks of said shell 1, as described with reference to FIG. 1.

In fact, a boot having a front portion which can be opened by transverse flaps is shown, by way of example, in FIGS. 8–12. As shown, the transverse flaps 66-65 are superposed from the tip of the boot and above the foot, up to the front zone 19 of the lower part of the leg where the flexible tightening straps 5 are located.

The instant application is based upon French Patent Application No. 95.12554, filed on Oct. 20, 1995, the disclosure of which is hereby expressly incorporated by reference thereto, and the priority of which is hereby claimed.

What is claimed is:

1. A sport boot comprising:

a shell base having opposed lateral sides extending at least to areas corresponding to the malleoli of a foot inserted within the boot;

an upper adapted to extend around a lower part of a leg inserted within the boot;

said upper comprising a rigid lower element having a pair of laterally opposed arms, a respective journal connecting each of said arms with a respective one of said lateral sides of said shell base;

said rigid lower element of said upper having a back zone having an approximately semi-tubular shape extending generally vertically to a position corresponding substantially to the base of the calf of the leg;

said upper further comprising a flexible upper element adapted to extend around the lower part of the leg, said flexible upper element being linked to said rigid lower element in at least a first linking zone;

said flexible upper element of said upper having a back zone, said back zone of said flexible upper element including at least one elastically deformable portion above said first linking zone;

said flexible upper element of said upper further comprising at least one strap and a tightening device affixed to said strap; and said flexible upper element, including said rear portion and said at least one strap, having a size and shape adapted to close the upper of the boot by surrounding the lower part of the leg, said elastically deformable portion and the flexibility of said flexible upper element being adapted to facilitate a relative adjustment of orientation of said flexible upper element with respect to said rigid lower element, thereby for adapting to a morphology of a rear zone of the lower part of the leg.

2. A sport boot according to claim 1, further comprising:

at least one linking element connecting said flexible upper element to said rigid lower element in said linking zone.

3. A sport boot according to claim 1, wherein:

said elastically deformable portion of said flexible upper element is constituted by a reduced dimension portion.

4. A sport boot according to claim 1, wherein:

said rigid lower element has a stirrup shape; and said flexible upper element has a collar shape.

5. A sport boot according to claim 1, wherein:

a lower rear portion of said upper element of said upper and an upper rear portion of said lower element of said upper are superposed in a superposed area; and said upper element and said lower element are connected by means of at least one linking element at said superposed area.

6. A sport boot according to claim 1, wherein:

said rigid lower element of said upper comprises at least a second flexible strap and a second tightening device affixed to said second strap, said rigid lower element thereby also being adapted, with said flexible upper element, to close the upper of the boot.

7. A sport boot according to claim 1, wherein:

one of said rigid lower element and said flexible upper element includes a vertically elongated slot; and a linking element extends through said slot to thereby provide for a vertical translational movement of said flexible upper element with respect to said rigid lower element.

8. A sport boot according to claim 7, further comprising:

an elastic member positioned between respective portions of said flexible upper element and said rigid lower element for elastically opposing said vertical translational movement of said flexible upper element with respect to said rigid lower element.

9. A sport boot according to claim 1, wherein:

said flexible upper element is connected to a vertically extending heel retention tongue of said shell base.

10. A sport boot according to claim 1, wherein:

said rigid lower element includes a vertically elongated slot; and said flexible upper element includes a lower finger extending through said elongated slot of said rigid lower portion and is connected to said shell base.

11. A sport boot according to claim 1, wherein:

said laterally opposed arms of said rigid lower element extend rearwardly from said journals to a single rear generally vertical rigid extension and form a shoulder, said arms having a height at said shoulder substantially above a heel area, said rigid extension extending vertically to an area corresponding to the base of the calf;

said rear portion of said flexible upper element, beneath said elastically deformable portion, comprises a downwardly open vertically extending scallop defining a pair of laterally opposed cheeks, said shoulder of said rigid lower element being positioned in said scallop to support said flexible upper element;

said lower element and said upper element are mounted together in a nested relationship, said cheeks of said upper element at least partially covering said arms of said lower element;

said vertical rigid extension covers said rear portion of said upper element above said scallop;

said first linking zone comprises a pair of laterally opposed linking elements between said cheeks of said upper element and respective portions of said lower element; and a second linking zone links an upper end of said vertical rigid extension and said rear portion of said upper element.

12. A sport boot according to claim 11, wherein:

said upper end of said vertical rigid extension comprises a fork having a pair of laterally opposed arms extending along respective sides of said rear portion of said upper element.

13. A sport boot according to claim 11, wherein:

said flexible upper element has an approximately semi-tubular shape and a transverse notch extending to said rear portion of said flexible upper element, thereby defining a junction portion easily deformable in flexion, said approximately semi-tubular shape extending vertically between said arms of said rigid lower element and said upper end of said vertical rigid extension of said rigid lower element; and said at least one strap includes a strap affixed to said semi-tubular shape of said upper element in the vicinity of said easily deformable junction portion.

14. A sport boot according to claim 1, wherein:

said at least one strap of said flexible upper element comprises two flexible straps, each of said flexible straps having a tightening device, both of said straps extending from said rear portion of said upper element and being separated by a notch, said notch extending to said rear portion of said upper element and defining said elastically deformable portion of said upper element, said elastically deformable portion facilitating flexional deformation of said upper element, said flexional deformation enabling said relative adjustment of orientation of said upper element with respect to said lower element, for adapting to the morphology of the rear zone of the lower part of the leg.

15. A sport boot comprising:

a shell base having opposed lateral sides extending at least to areas corresponding to the malleoli of a foot inserted within the boot;

an upper adapted to extend around a lower part of a leg inserted within the boot;

said upper comprising a rigid lower element having a pair of laterally opposed arms, a respective journal connecting each of said arms with a respective one of said lateral sides of said shell base;

said rigid lower element of said upper having a back zone having an approximately semi-tubular shape extending generally vertically to a position corresponding substantially to the base of the calf of the leg;

said upper further comprising a flexible upper element adapted to extend around the lower part of the leg, said flexible upper element being linked to said rigid lower element in at least a first linking zone;

said flexible upper element of said upper comprising a back zone, said back zone of said flexible upper element including at least one elastically deformable portion above said first linking zone;

said flexible upper element of said upper further comprising at least one strap and a tightening device affixed to said strap;

said flexible upper element comprising means for closing the boot upon the lower part of the leg, said closing means comprising:

means for surrounding the lower part of the leg, said surrounding means including said rear portion of said upper element and said at least one strap; and means for adjusting an orientation of said upper to adapt to a morphology of a rear zone of the lower part of the leg, said adjusting means including the flexibility of said flexible upper element and said at least one elastically deformable portion of said flexible upper element.

16. A sport boot according to claim 15, further comprising:

at least one linking element connecting said flexible upper element to said rigid lower element in said linking zone.

17. A sport boot according to claim 15, wherein:

said elastically deformable portion of said flexible upper element is constituted by a reduced dimension portion.

18. A sport boot comprising:

a shell base having opposed lateral sides extending at least to areas corresponding to the malleoli of a foot inserted within the boot;

an upper adapted to extend around at least a rear lower part of a leg inserted within the boot;

said upper comprising a rigid lower element having a pair of laterally opposed arms, a respective journal connecting each of said arms with a respective one of said lateral sides of said shell base;

said rigid lower element of said upper having a back zone generally vertically extending to a position corresponding substantially to the base of the calf of the leg, said back zone having a shape adapted to extend partially around the lower part of the leg;

said upper further comprising a flexible upper element adapted to extend partially around the lower part of the leg, said flexible upper element being linked to said rigid lower element in at least a first linking zone;

said flexible upper element of said upper having a back zone, said back zone of said flexible upper element including at least one elastically deformable portion above said first linking zone;

said flexible upper element of said upper further comprising at least one strap and a tightening device affixed to said strap; and said flexible upper element, including said rear portion and said at least one strap, having a size and shape adapted to close the upper of the boot by surrounding the lower part of the leg, said elastically deformable portion and the flexibility of said flexible upper element being adapted to facilitate a relative adjustment of orientation of said flexible upper element with respect to said rigid lower element, thereby for adapting to a morphology of a rear zone of the lower part of the leg.

19. A sport boot according to claim 18, wherein:

said laterally opposed arms of said rigid lower element extend rearwardly from said journals to a single rear generally vertical rigid extension and form a shoulder, said arms having a height at said shoulder substantially above a heel area, said rigid extension extending vertically to an area corresponding to the base of the calf;

said rear portion of said flexible upper element, beneath said elastically deformable portion, comprises a downwardly open vertically extending recess defining a pair of laterally opposed cheeks, said shoulder of said rigid lower element being positioned in said recess to support said flexible upper element;

said lower element and said upper element are mounted together in a nested relationship, said cheeks of said upper element at least partially covering said arms of said lower element;

said vertical rigid extension covers said rear portion of said upper element above said recess;

said first linking zone comprises a pair of laterally opposed linking elements between said cheeks of said upper element and respective portions of said lower element; and a second linking zone links an upper end of said vertical rigid extension and said rear portion of said upper element.

20. A sport boot according to claim 18, wherein:

a front cuff is connected to said shell base and is adapted to be positioned at a front lower part of the leg inserted within the boot.

21. A sport boot according to claim 18, further comprising:

at least one linking element connecting said flexible upper element to said rigid lower element in said linking zone.

22. A sport boot according to claim 18, wherein:

said at least one strap of said flexible upper element comprises two flexible straps, each of said flexible straps having a tightening device, both of said straps extending from said rear portion of said upper element and being separated by a notch, said notch extending to said rear portion of said upper element and defining said elastically deformable portion of said upper element, said elastically deformable portion facilitating flexional deformation of said upper element, said flexional deformation enabling said relative adjustment of orientation of said upper element with respect to said lower element, for adapting to the morphology of the rear zone of the lower part of the leg.

23. A sport boot according to claim 18, wherein:

said flexible upper element has an approximately semi-tubular shape and a transverse notch extending to said rear portion of said flexible upper element, thereby defining a junction portion easily deformable in flexion, said approximately semi-tubular shape extending vertically between said arms of said rigid lower element and said upper end of said vertical rigid extension of said rigid lower element; and said at least one strap includes a strap affixed to said semi-tubular shape of said upper element in the vicinity of said easily deformable junction portion.

24. A sport boot according to claim 18, wherein:

said elastically deformable portion of said flexible upper element is constituted by a reduced dimension portion.

* * * * *